US008104302B2

(12) United States Patent
Hayase et al.

(10) Patent No.: US 8,104,302 B2
(45) Date of Patent: Jan. 31, 2012

(54) LOW-TEMPERATURE SHOWCASE

(75) Inventors: Koji Hayase, Ota (JP); Kazuo Tetsukawa, Isesaki (JP)

(73) Assignee: Sanyo Electric Co., Ltd., Moriguchi-shi (JP)

( * ) Notice: Subject to any disclaimer, the term of this patent is extended or adjusted under 35 U.S.C. 154(b) by 284 days.

(21) Appl. No.: 11/826,095

(22) Filed: Jul. 12, 2007

(65) Prior Publication Data

US 2008/0016893 A1 Jan. 24, 2008

(30) Foreign Application Priority Data

Jul. 19, 2006 (JP) ..... 2006-197203

(51) Int. Cl.
*A47F 3/04* (2006.01)
*F25B 47/00* (2006.01)
*F25D 21/14* (2006.01)

(52) U.S. Cl. ..... 62/248; 62/246; 62/279; 62/285

(58) Field of Classification Search ..... 62/248, 62/150, 246, 279; 312/138.1
See application file for complete search history.

(56) References Cited

U.S. PATENT DOCUMENTS 3,307,373 A * 3/1967 Booth ..... 62/248
4,197,718 A * 4/1980 Abraham et al. ..... 62/248
4,347,710 A * 9/1982 Ibrahim ..... 62/155
4,478,047 A * 10/1984 Ibrahim ..... 62/82
4,750,335 A * 6/1988 Wallace et al. ..... 62/248
4,953,362 A * 9/1990 Shoji et al. ..... 62/246
4,977,754 A * 12/1990 Upton et al. ..... 62/248
5,033,803 A 7/1991 Katsuyoshi et al. ..... 312/138.1
5,374,116 A * 12/1994 Borgen et al. ..... 312/116
5,468,185 A * 11/1995 Truitt ..... 454/198
5,606,863 A * 3/1997 Kicklighter et al. ..... 62/89
5,699,677 A * 12/1997 Hakala et al. ..... 62/291
6,047,555 A * 4/2000 Weng ..... 62/171
6,151,904 A * 11/2000 Jin ..... 62/248
6,378,324 B1 * 4/2002 Percy et al. ..... 62/448
6,412,296 B1 * 7/2002 Rossi ..... 62/255

(Continued)

FOREIGN PATENT DOCUMENTS

JP 05-203332 8/1993

(Continued)

OTHER PUBLICATIONS

European Search Report of Nov. 20, 2007.

(Continued)

*Primary Examiner* — Marc Norman
*Assistant Examiner* — Filip Zec
(74) *Attorney, Agent, or Firm* — Kratz, Quintos & Hanson, LLP

(57) ABSTRACT

There is disclosed a low-temperature showcase in which dew condensation water from outer surfaces of transparent walls is securely treated and in which air can smoothly be blown from a mechanical chamber to the outer surfaces of the transparent walls. The low-temperature showcase includes a showroom having the transparent walls, the mechanical chamber constituted under this showroom, and a cooling unit constituted of a compressor, a condenser, a fan for the condenser and the like arranged in the mechanical chamber. The low-temperature showcase further comprises blow-off portions which are formed at lower portions of the transparent walls and which blow air discharged from the fan for the condenser in the mechanical chamber toward outer surfaces of the transparent walls, and water receiving portions which are defined between the blow-off portions and the outer surfaces of the transparent walls and which allows inflow of dew condensation water flowing down along the outer surfaces of the transparent walls.

9 Claims, 10 Drawing Sheets

U.S. PATENT DOCUMENTS

| | | | | |
|---|---|---|---|---|
| 6,675,588 | B2 * | 1/2004 | Rudick | 62/6 |
| 6,708,518 | B1 * | 3/2004 | Jones et al. | 62/389 |
| 6,889,514 | B2 * | 5/2005 | Lane et al. | 62/246 |
| 6,990,824 | B1 * | 1/2006 | Jaffer et al. | 62/255 |

FOREIGN PATENT DOCUMENTS

| | | |
|---|---|---|
| JP | 5-203332 | 8/1993 |
| JP | 08-054171 | 2/1996 |
| JP | 2000-88438 | 3/2000 |
| JP | 2001-133125 | 5/2001 |
| JP | 2001-245759 | 9/2001 |

OTHER PUBLICATIONS

Japanese Office Action mailed Jul. 12, 2011 issue on counterpart Japanese Application No. 2006-197203 (3 pages).

* cited by examiner

LOW-TEMPERATURE SHOWCASE

BACKGROUND OF THE INVENTION

The present invention relates to a low-temperature showcase including a showroom having wall surfaces constituted of transparent walls.

Heretofore, in this type of low-temperature showcase, commodities such as beverages and foods are stored in a showroom, and cold air is circulated through the showroom to lower a temperature thereof. In consequence, the commodities are displayed while cooled. In this case, a front surface (a door surface) of the showroom, three surfaces including the front surface and left and right surfaces or four surrounding surfaces are constituted of transparent walls of transparent glass or the like, so that the commodities can visually be recognized from the outside to improve a sales effect.

Since the showroom of the low-temperature showcase is at a low temperature in this manner, humidity of outside air is condensed to dew on outer surfaces of the transparent walls owing to a temperature difference between the low-temperature showroom and the outside air. When such dew condensation occurs, the transparent walls collect moisture, and visibility of the showroom deteriorates. To solve the problem, heretofore an electric heater or the like has been attached to eliminate this moisture. However, when the electric heater is used, power consumption inconveniently increases. Accordingly, the showcase has been contrived so as to blow air (warm air) warmed by a compressor and a condenser installed in a mechanical chamber to the outer surface (the front surface) of the glass door (the transparent wall), thereby eliminating the dew condensation (e.g., see Japanese Patent Application Laid-Open No. 2000-88438).

In addition, in a case where the outside air has a very humid state, even when the warm air is blown from the mechanical chamber to the outer surface of the glass door (the transparent wall), the dew condensation unavoidably occurs on the outer surface of the transparent wall. In such a case, as described in the above patent document, a dew receiving portion is disposed under the door, and the air is blown from the mechanical chamber to the outer surface of the door via an externally disposed blow-off port. In consequence, dew condensation water which flows down along the door flows into the dew receiving portion disposed under the door.

However, the showcase is constituted so that the dew condensation water is drawn from the outer surface (the front surface) of the door to a lower surface of the door owing to surface tension to drip down the water to the dew receiving portion. Therefore, when an amount of the dew condensation water increases, the water unavoidably drips down to the externally disposed blow-off port to wet a portion around the blow-off port. In the worst case, there has been a problem that the blow-off port is sealed with the water.

SUMMARY OF THE INVENTION

The present invention has been developed to solve such a conventional technical problem, and an object thereof is to provide a low-temperature showcase in which dew condensation water from outer surfaces of transparent walls is securely treated and in which air can smoothly be blown from a mechanical chamber to the outer surfaces of the transparent walls.

A low-temperature showcase of a first invention includes a showroom having transparent walls, a mechanical chamber constituted under the showroom, and a cooling unit constituted of a compressor, a condenser, a fan for the condenser and the like arranged in this mechanical chamber, and is characterized by further comprising: blow-off portions which are formed at lower portions of the transparent walls and which blow air discharged from the fan for the condenser in the mechanical chamber toward outer surfaces of the transparent walls; and dew condensation water inflow portions which are defined between the blow-off portions and the outer surfaces of the transparent walls and which allows inflow of dew condensation water flowing down along the outer surfaces of the transparent walls.

Moreover, a low-temperature showcase of a second invention is characterized in that, in the above invention, the showroom has four surrounding surfaces which are surrounded with the plurality of transparent walls and that the blow-off portions and the dew condensation water inflow portions are formed at the lower portions of the transparent walls of all the surfaces.

Furthermore, a low-temperature showcase of a third invention is characterized in that the above inventions further comprise: a cold air discharge port and a cold air suction port which are formed inwardly from the lower portions of the transparent walls and via which cold air is circulated through the showroom and that an amount of the air to be blown from the blow-off portion formed at the lower portion of the transparent wall on the side of the cold air discharge port is set to be larger than an amount of the air to be blown from the blow-off portion formed at the lower portion of the transparent wall on the side of the cold air suction port.

In addition, a low-temperature showcase of a fourth invention is characterized in that the above inventions further comprise: a door which openably close opening of the showroom and which includes the transparent wall and a sash to hold the transparent wall; and lower blow-off port which is formed under the sash and which blows the air discharged from the fan for the condenser away from the door and that the blow-off portion is formed at lower side of the sash, and the air blown from the lower blow-off port flows into the blow-off portion in a state in which the door is closed.

According to the first invention, the low-temperature showcase includes the showroom having the transparent walls, the mechanical chamber constituted under this showroom and the cooling unit constituted of the compressor, the condenser, the fan for the condenser and the like arranged in this mechanical chamber. The low-temperature showcase further comprises the blow-off portions which are formed at lower portions of the transparent walls and which blow the air discharged from the fan for the condenser in the mechanical chamber toward the outer surfaces of the transparent walls, and the dew condensation water inflow portions which are defined between the blow-off portions and the outer surfaces of the transparent walls and which allows inflow of the dew condensation water flowing down along the outer surfaces of the transparent walls. Therefore, without using any electric heater or the like, warm air can be blown from the mechanical chamber to the outer surfaces of the transparent walls via the blow-off portions to effectively eliminate or suppress dew condensation on the outer surfaces of the transparent walls.

Especially, the dew condensation water inflow portions into which the dew condensation water flows are defined between the blow-off portions and the outer surfaces of the transparent walls. Therefore, even if the dew condensation occurs on the outer surfaces of the transparent walls, the dew condensation water which has flowed down along the outer surfaces of the transparent walls flows into the dew condensation water inflow portions as it is. In consequence, disadvantages that the dew condensation water turns to a blow-off portion side to wet a surrounding area and that the blow-off portions are sealed with water can securely or effectively be prevented. A function of blowing the air to the outer surfaces of the transparent walls can constantly satisfactorily be maintained.

Moreover, in a case where the blow-off portions and the dew condensation water inflow portions are formed at the lower portions of the transparent walls of all the surfaces which surround the four surrounding surfaces of the showroom as in the second invention, the dew condensation on the transparent walls of the four surrounding surfaces which surround the showroom can effectively be eliminated or suppressed, and a great effect of improving visibility can be obtained.

Furthermore, according to the third invention, in addition to the above inventions, the low-temperature showcase further comprises the cold air discharge port and the cold air suction port which are formed inwardly from the lower portions of the transparent walls and via which the cold air is circulated through the showroom. The amount of the air to be blown from the blow-off portion formed at the lower portion of the transparent wall on the side of the cold air discharge port is set to be larger than the amount of the air to be blown from the blow-off portion formed at the lower portion of the transparent wall on the side of the cold air suction port. Therefore, the amount of the air to be blown to the outer surface of the transparent wall on the side of the cold air discharge port, on which the dew condensation easily occurs at a lower temperature, can be increased to effectively eliminate or suppress the dew condensation on the outer surface of the transparent wall.

Moreover, according to the fourth invention, in addition to the above inventions, the low-temperature showcase further comprises the door which openably closes the opening of the showroom and which includes the transparent wall and the sash to hold the transparent wall, and the lower blow-off port which is formed under the sash and which blows the air discharged from the fan for the condenser away from the door. The blow-off portion is formed at the lower side of the sash, and the air blown from the lower blow-off port flows into the blow-off portion in a state in which the door is closed. Therefore, in a state in which the door is closed, the air blown from the lower blow-off port is blown to the outer surfaces of the transparent wall via the blow-off portion formed at the lower side of the sash. In consequence, the dew condensation on the outer surface of the transparent wall constituting the door is eliminated or suppressed.

Especially, the lower blow-off ports blow the air discharged from the fan for the condenser away from the door. Therefore, it is possible to prevent or suppress a disadvantage that the warm air blown from the lower blow-off port flow into the opened showroom in a case where the door is opened. In consequence, it is possible to minimize an adverse influence on the effect of cooling the inside of the showroom with the air from the fan for the condenser.

DETAILED DESCRIPTION OF THE PREFERRED EMBODIMENT

Figure 1:
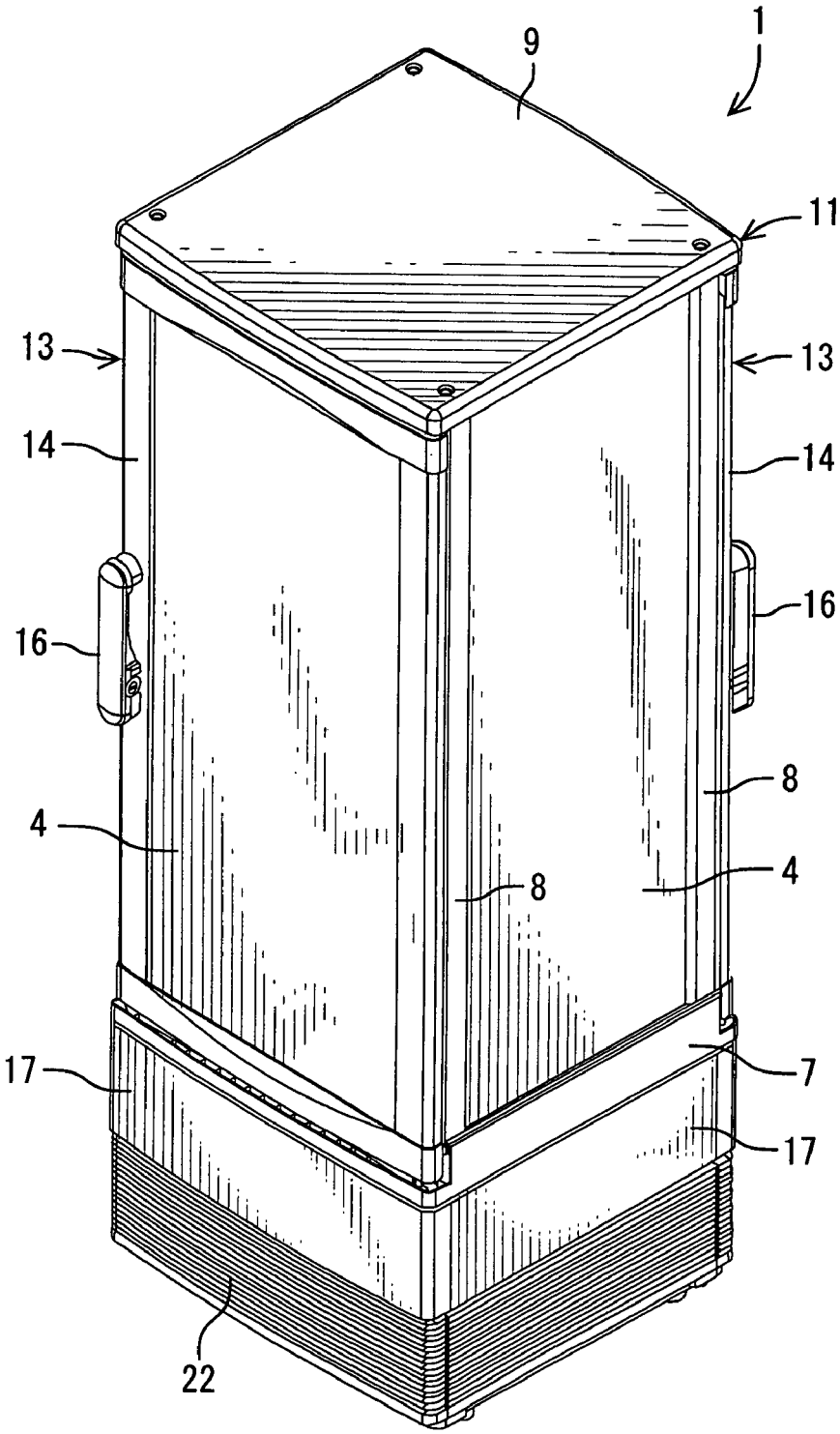
FIG. 1 is a perspective view of a low-temperature showcase of an embodiment to which the present invention is applied.
Figure 2:
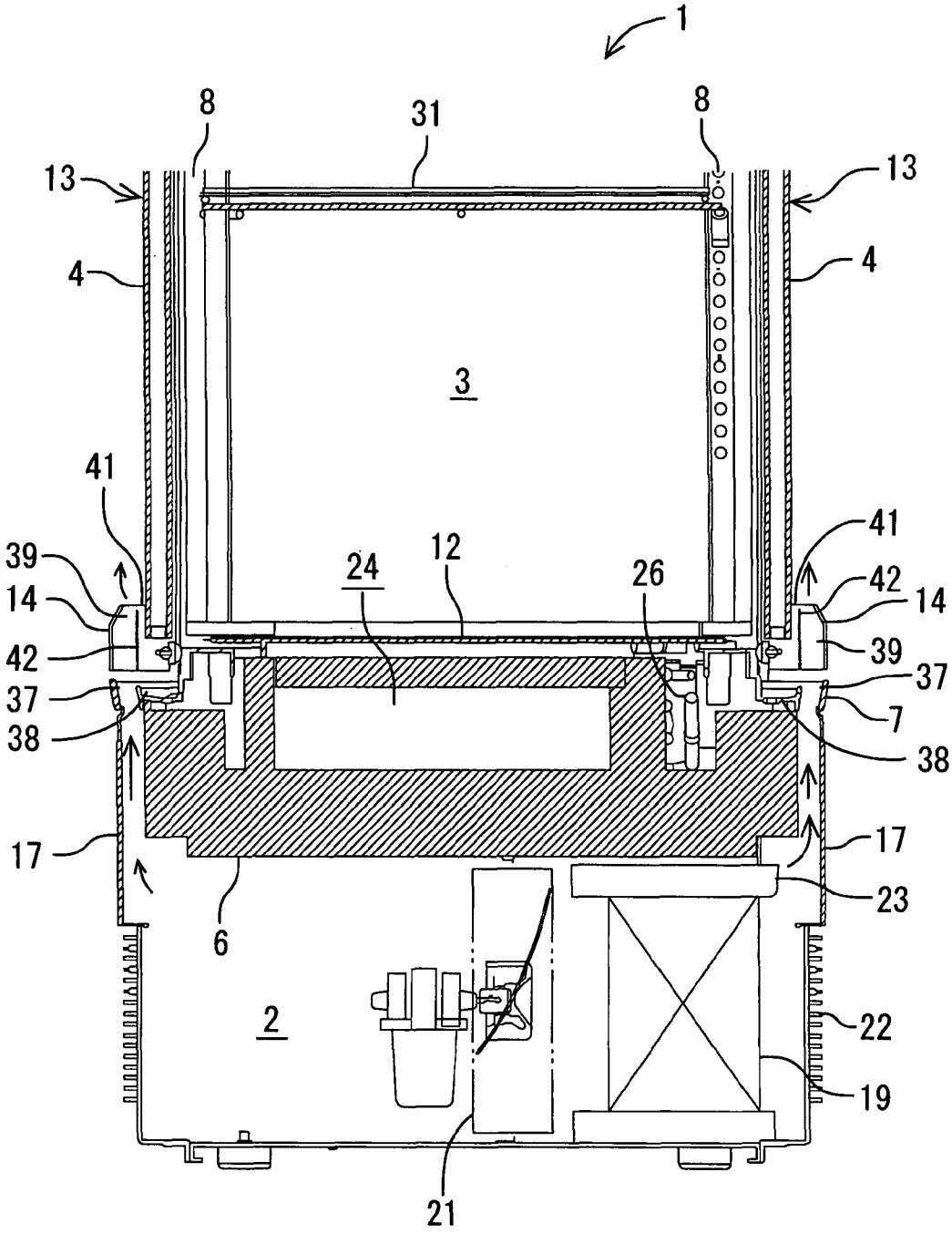
FIG. 2 is a vertical side view of a lower part of the low-temperature showcase of FIG. 1.
Figure 3:
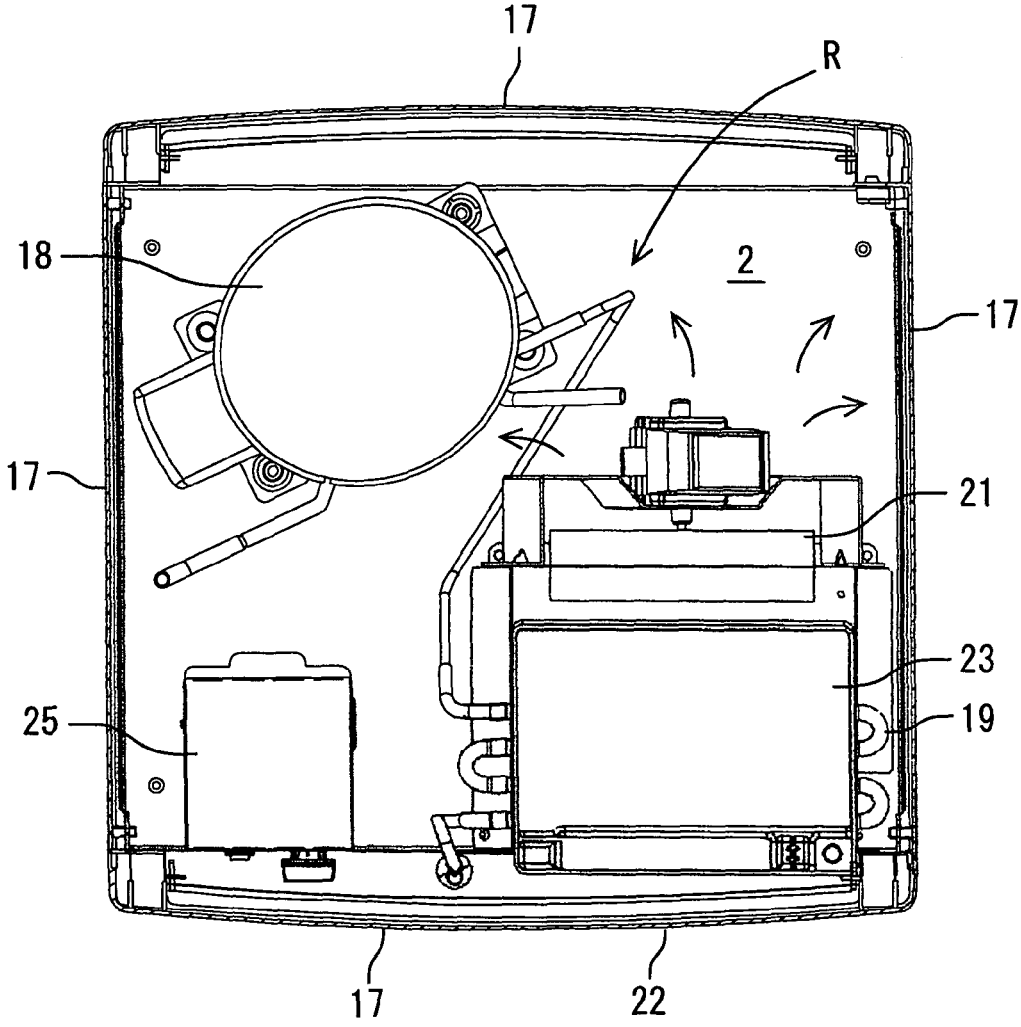
FIG. 3 is a sectional plan view of a mechanical chamber part of the low-temperature showcase of FIG. 1.

An embodiment of the present invention will hereinafter be described in detail with reference to the drawings.

A low-temperature showcase 1 of the embodiment is a so-called desk-top showcase including a showroom 3. Four surrounding surfaces of the showroom are surrounded with transparent walls 4 . . . made of double transparent glass. A container-like insulating wall 6 made of foam polyurethane, a bottom frame 7 with which a periphery of an upper surface of this insulating wall 6 is edged and which is made of a hard synthetic resin, supports 8 . . . vertically disposed at four corners of this bottom frame 7, a top plate 9, the transparent walls 4, 4 of the left and right surfaces held by these bottom frame 7, supports 8 and top plate 9 and the like constitute a main body 11. A bottom plate 12 made of a hard synthetic resin is attached to an upper surface of the insulating wall 6 disposed inwardly from the transparent walls 4, 4 of the left and right surfaces, and the showroom 3 is constituted in the main body 11 defined by these bottom plate 12, top plate 9 and left and right transparent walls 4, 4.

A front surface and a rear surface of the showroom 3 are opened, and these front and rear openings are openably closed with doors 13, 13. The same door is used in the front and rear doors 13, 13. Upper and lower portions of the doors 13, 13 on the right as one faces are rotatably supported by and attached to the top plate 9 and the bottom frame 7 of the main body 11. The doors 13 include peripheral sashes 14 made of a hard synthetic resin, and the transparent walls 4 made of double transparent glass and held inwardly from the sashes 14. A handle 16 is attached to the front surface of the door on one non-supported side, that is, the front surface of each sash 14 on the left as one faces. It is to be noted that, in each enlarged view, G is a gasket.

Moreover, a mechanical chamber 2 is constituted under the insulating wall 6 and positioned under the showroom 3, and a periphery of the mechanical chamber is covered with panels 17. In this mechanical chamber 2, a compressor 18 and a condenser 19 which constitute a refrigerant circuit of a cooling unit R are arranged, and a fan 21 for the condenser is installed in order to cool the compressor and the condenser with air. Moreover, the condenser 19 is positioned on the right in the mechanical chamber 2 as viewed from the front surface, and disposed inwardly from the front-surface panel 17 of the mechanical chamber 2. The front-surface panel 17 disposed before this condenser 19 is provided with an outside air suction port 22 through which outside air is sucked. The fan 21 for the condenser is disposed behind the condenser 19, and the compressor 18 is positioned on an inner left side from the condenser and the fan as viewed from the front surface. It is to be noted that reference numeral 23 is an evaporation pan, and 25 is an electric equipment box.

On the other hand, a cooling chamber 24 is constituted in the insulating wall 6. In this cooling chamber 24, an evaporator 26 which constitutes the refrigerant circuit of the cooling unit R together with the compressor 18 and the like, and a fan 27 for cooling are stored. A discharge port (not shown) formed at an inner bottom portion of this cooling chamber 24 is disposed so as to communicate with the evaporation pan 23. A cold air suction port 28 positioned at a bottom part of the showroom 3 and extending front and rear is formed on the right side of the bottom plate 12 as viewed from the front surface of the low-temperature showcase 1. On the left side of the bottom plate 12, a cold air discharge port 29 is positioned at the bottom part of the showroom 3, and formed so as to extend front and rear. The cold air discharge port 29 communicates with the inside of the cooling chamber 24 on a discharge side of the fan 27 for cooling, and the cold air suction port 28 communicates with the inside of the cooling chamber 24 on a cold air inflow side of the evaporator 26. It is to be noted that reference numeral 31 is a net rack for displaying the commodities, which is disposed in the showroom 3.

At upper left and right edge portions of the bottom frame 7, blow-off ports 33 as blow-off portions are substantially formed over the whole widths of the transparent walls 4 and positioned outside lower portions of the transparent walls 4. Outside lower portions of the transparent walls 4 between this blow-off ports 33 and the outer surfaces of the transparent wall 4, water receiving portions 34 as dew condensation water inflow portions are substantially formed over the whole widths of the transparent walls 4, respectively. The blow-off ports 33 communicate with the inside of the mechanical chamber 2 disposed under the blow-off ports, and upper end openings of the ports are obliquely directed upwards to the outer surfaces of the transparent walls 4. A partition wall 36 is formed outside the water receiving portion 34, that is, on a blow-off port 33 side, and the water receiving portion 34 and the blow-off port 33 are separated from each other by this partition wall 36. The outer surface of each transparent wall 4 is positioned inwardly from the water receiving portion 34. The water receiving portion 34 opens upwards, and a lower portion of the water receiving portion communicates with the inside of the cooling chamber 24 disposed inwardly from the insulating wall 6 (see FIG. 10).

Figure 4:
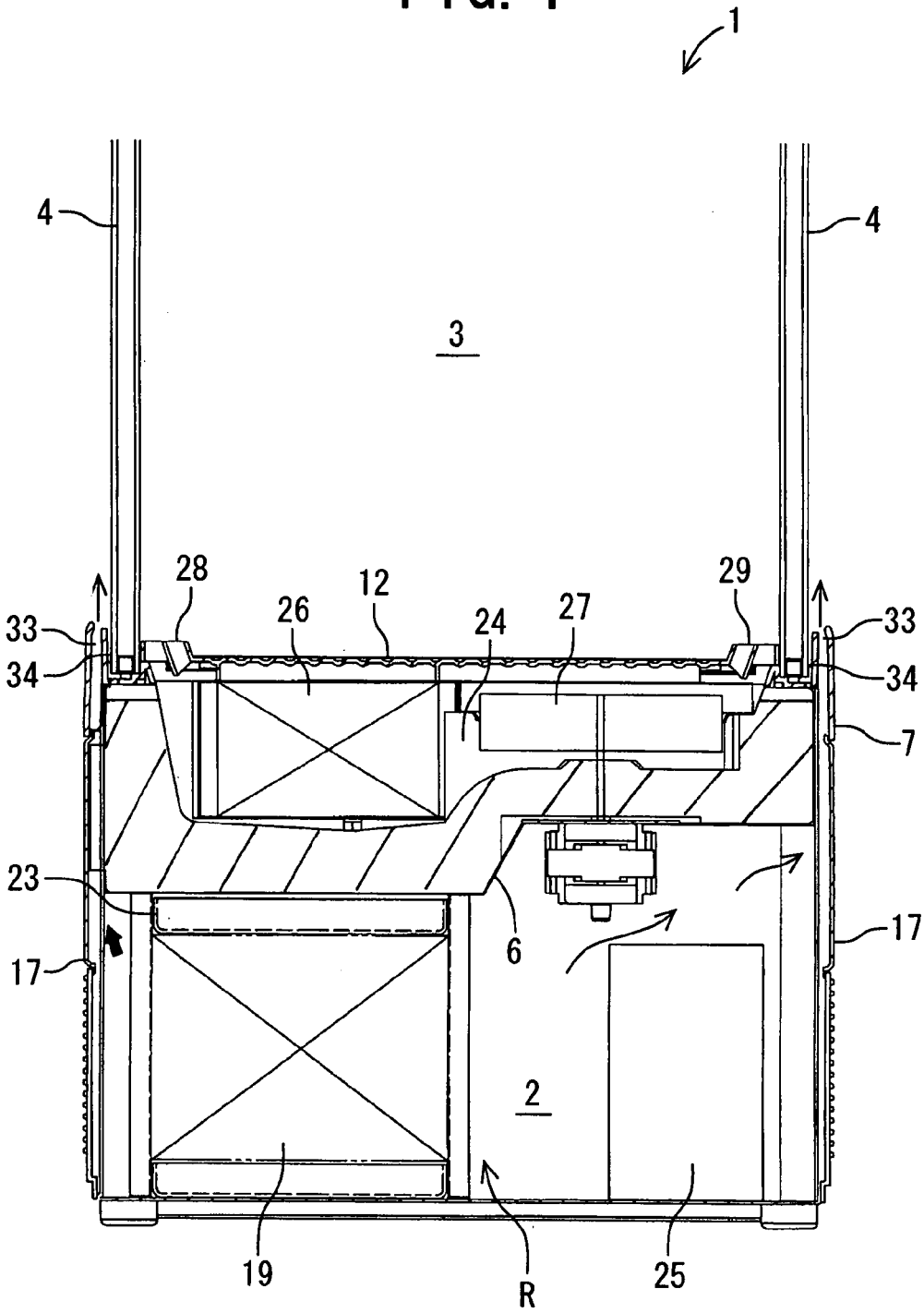
FIG. 4 is a vertical rear view of the lower part of the low-temperature showcase of FIG. 1.
Figure 5:
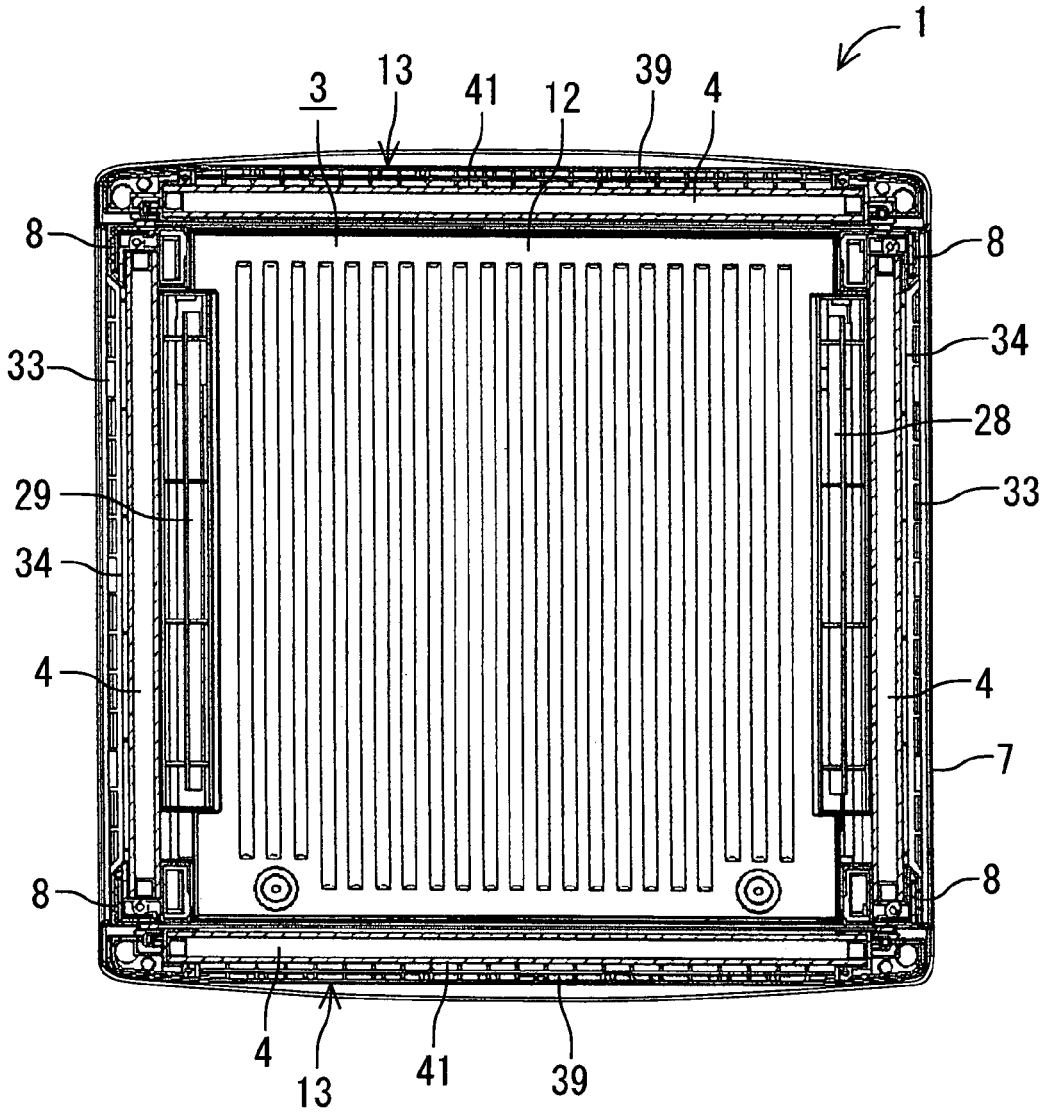
FIG. 5 is a sectional plan view of a showroom part of the low-temperature showcase of FIG. 1.
Figure 8:
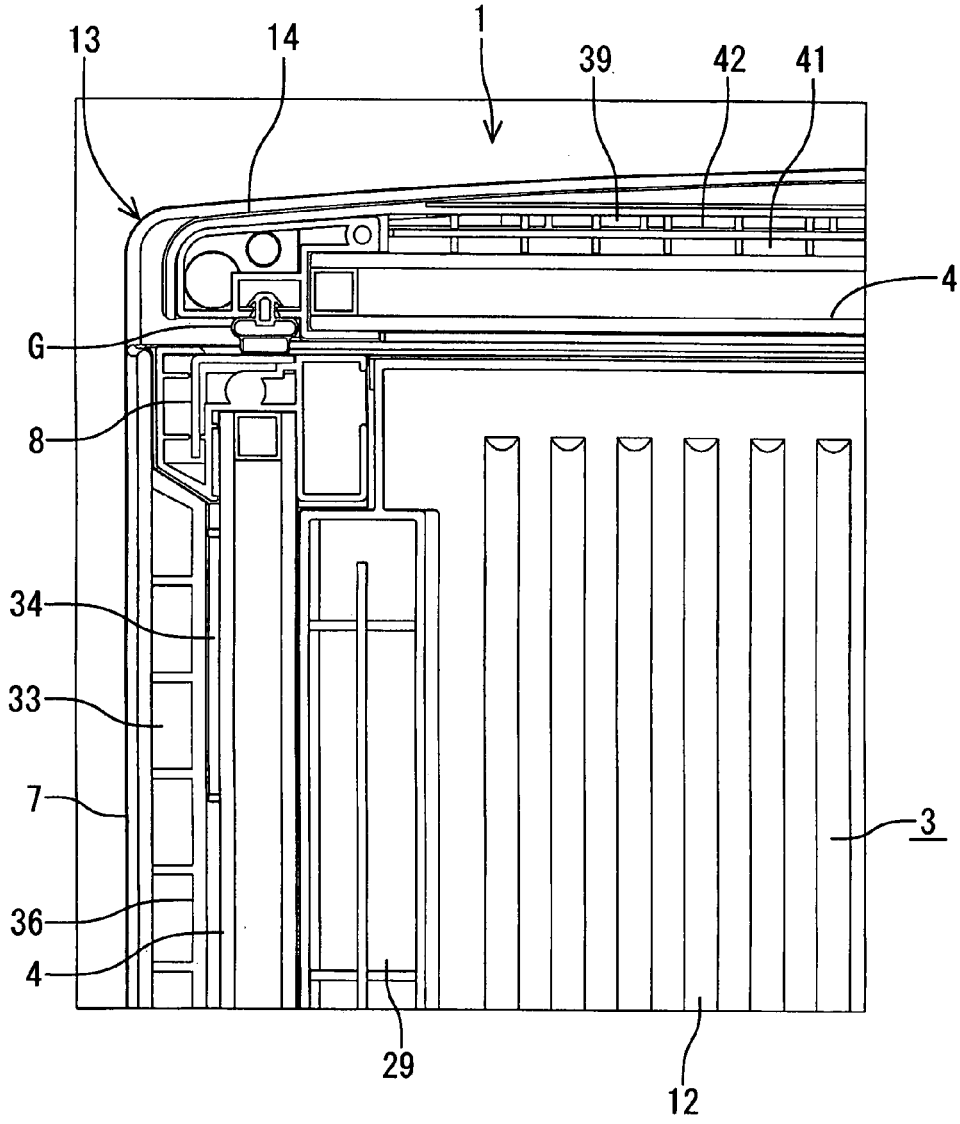
FIG. 8 is an enlarged sectional plan view of the showroom part of the low-temperature showcase of FIG. 1 cut above a cold air discharge port.
Figure 9:
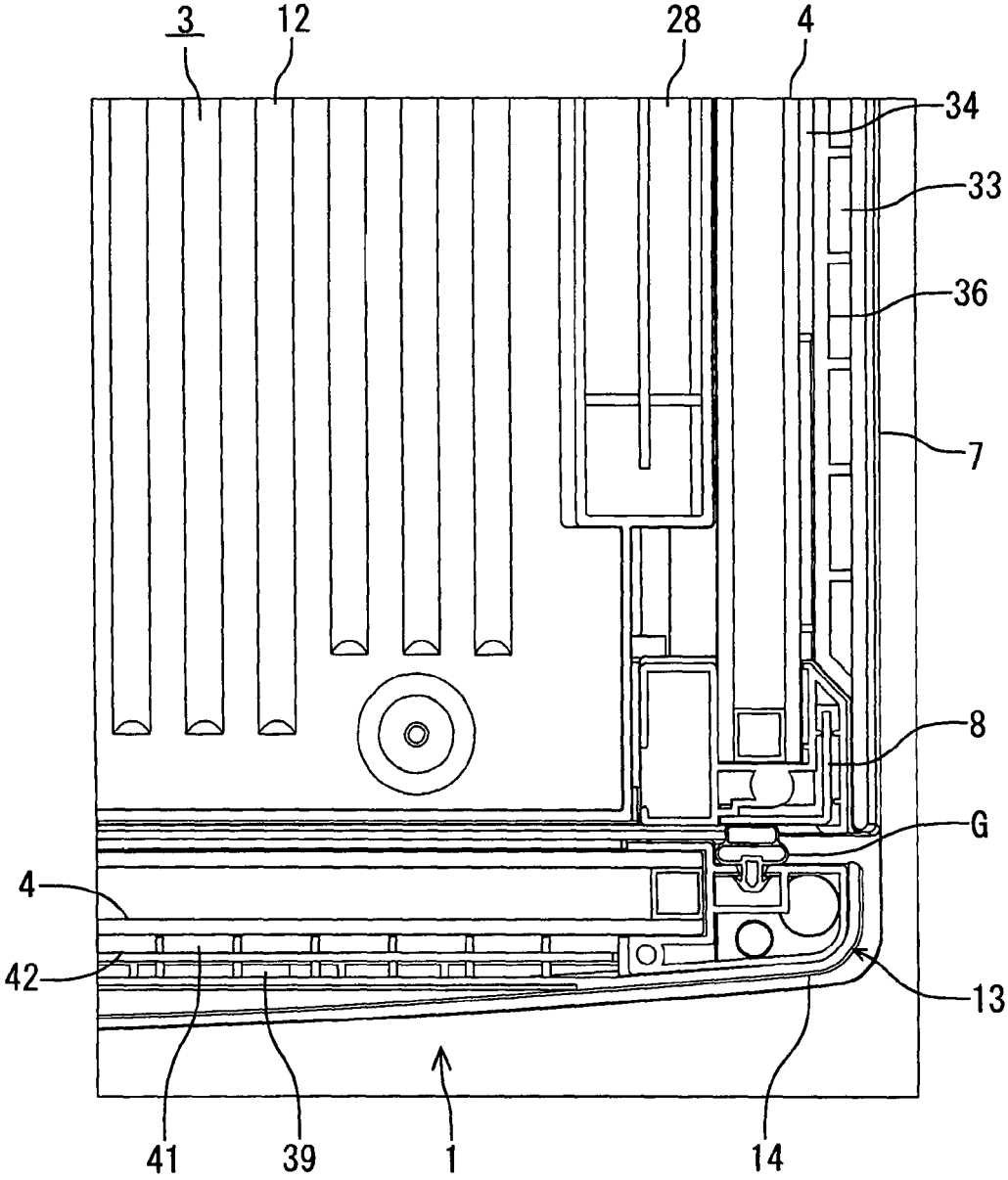
FIG. 9 is an enlarged sectional plan view of the showroom part of the low-temperature showcase of FIG. 1 cut above a cold air suction port.

Moreover, an opening area (see FIG. 8) of the blow-off port 33 disposed outside the cold air discharge port 29 and positioned at a lower portion of the transparent wall 4 on the left as one faces from the front surface is set to be larger than an opening area (see FIG. 9) of the blow-off port 33 disposed outside the cold air suction port 28 and positioned at a lower portion of the transparent wall 4 on the right as one faces from the front surface. Furthermore, a condenser 19-side (the right as viewed from the front surface) portion of the bottom surface of the insulating wall 6 on the right as viewed from the front surface is formed to be lower than a portion of the bottom surface of the insulating wall on the left as viewed from the front surface (see FIG. 4. Since FIG. 4 is viewed from a rear surface, a reverse direction is shown).

Figure 6:
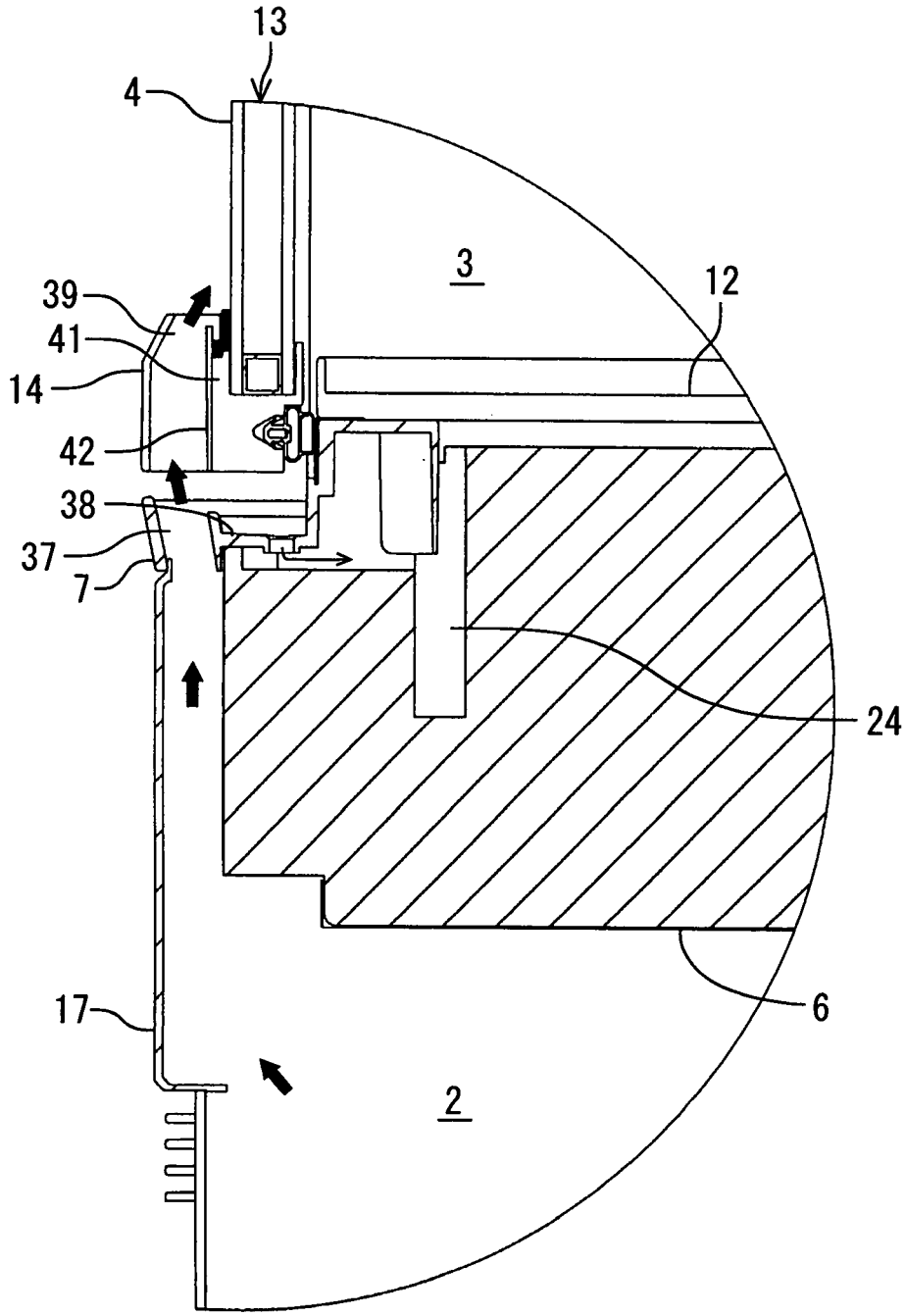
FIG. 6 is an enlarged vertical side view of a bottom frame part of the low-temperature showcase of FIG. 1 in a state in which a rear-surface door is closed.

On the other hand, upper front and rear edge portions of the bottom frame 7 disposed under the front and rear doors 13, 13 are provided with lower blow-off ports 37 substantially formed over the whole widths of the doors 13. Inwardly from each lower blow-off ports 37, a dew receiving portion 38 is substantially formed over the whole width of each door 13. The lower blow-off ports 37 communicate with the inside of the mechanical chamber 2 disposed under the lower blow-off ports. As shown in FIG. 6, an upper end opening of each lower blow-off port 37 is directed away from the door 13, that is, obliquely upwards and outwards. The dew receiving portions 38 communicate with the inside of the cooling chamber 24 disposed inwardly from the insulating wall 6.

On the other hand, inwardly from a lower side of each sash 14 constituting the door 13, a blow-off port 39 as a blow-off portion is substantially formed over the whole width of the transparent wall 4, and positioned at a lower outer portion of the transparent wall 4. At the lower outer portion of the transparent wall 4 between this blow-off port 39 and the outer surface of the transparent wall 4, a water receiving portion 41 as a dew condensation water inflow portion is substantially formed over the whole width of each transparent wall 4. When the door 13 is closed, a lower, end opening of the blow-off port 39 is positioned right above an upper end opening of the lower blow-off port 37 of the bottom frame 7 disposed under the blow-off port 39, and an upper end opening of the blow-off port 39 is obliquely directed upwards to the outer surface of the transparent wall 4. Moreover, partition walls 42 are formed outside the water receiving portions 41, that is, on the side of each blow-off port 39, and the water receiving portion 41 and the blow-off port 39 are separated from each other by this partition wall 42. The outer surface of the transparent wall 4 is positioned inwardly from the water receiving portion 41. The water receiving portion 41 opens upwards, and a lower portion of the water receiving portion is positioned above the dew receiving portion 38 of the bottom frame 7 in a state in which the door 13 is closed (FIG. 6).

Figure 10:
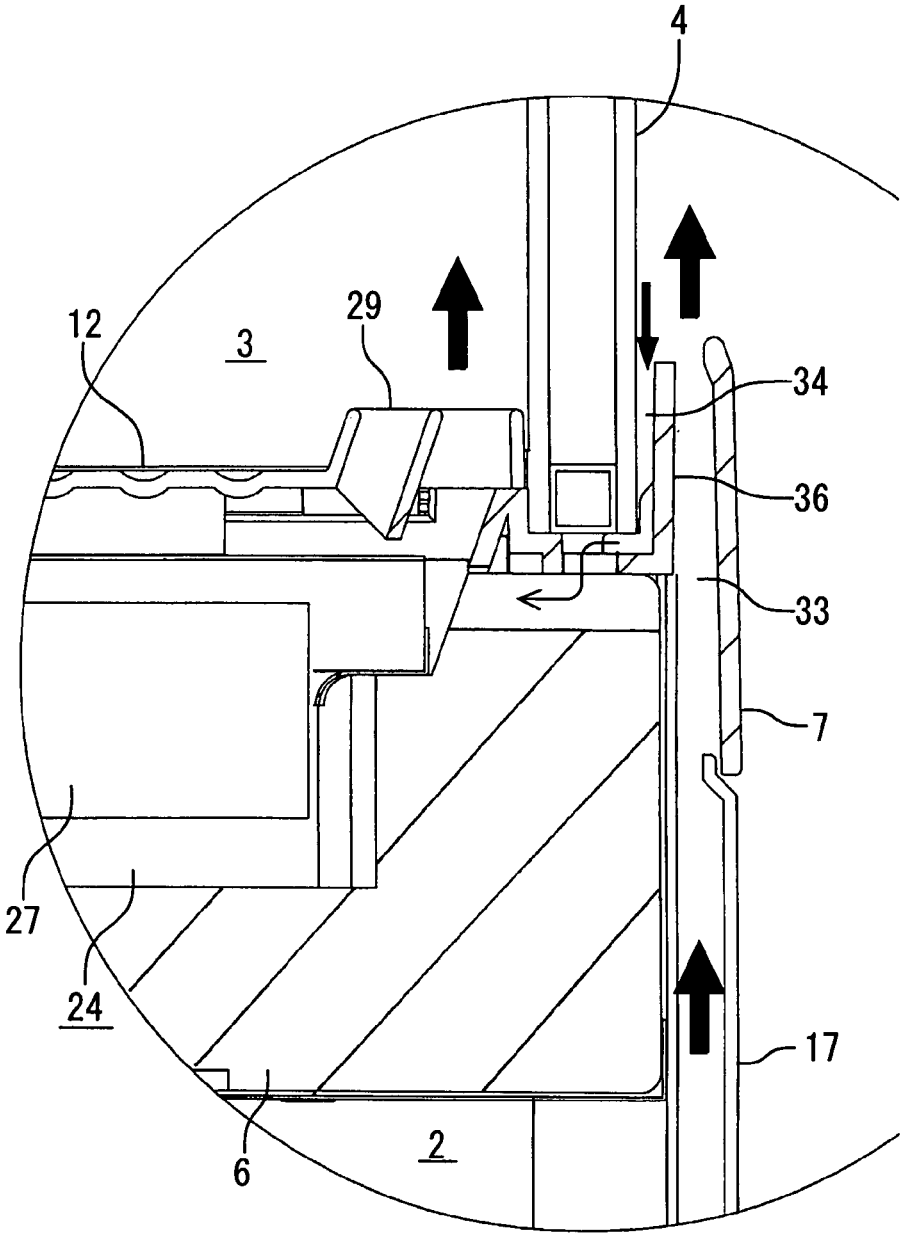
FIG. 10 is an enlarged vertical rear view of a cold air discharge port portion of the low-temperature showcase of FIG. 1.

According to the above constitution, when the compressor 18, the fan 21 for the condenser and the fan 27 for cooling are operated, the evaporator 26 performs a cooling function. The condenser 19 and the compressor 18 generate heat to heat surrounding air. The cold air of the cooling chamber 24 cooled by heat exchange between the cooling chamber and the evaporator 26 is sucked by the fan 27 for cooling, and discharged upwards into the showroom 3 from the cold air discharge port 29 as shown in FIG. 10. The cold air discharged into the showroom 3 moves upwards, and is circulated through the showroom 3 to cool the commodities on the rack 31 and the like. Subsequently, the air moves downwards to return from the cold air suction port 28 into the cooling chamber 24. Furthermore, after the air flows into the evaporator 26 and is cooled, the air is sucked by the fan 27 for cooling again, and discharged from the cold air discharge port 29.

In consequence, the inside of the showroom 3 is cooled at a predetermined temperature (usually at a refrigeration temperature of +5° C. to +10° C.). Therefore, the left and right transparent walls 4, 4 and the transparent walls 4, 4 of the doors 13, 13 with which the four surrounding surfaces of the showroom 3 are surrounded are subjected to the cooling function. Especially, the low-temperature cold air immediately after discharged into the showroom 3 is blown against the left transparent wall 4 facing the cold air discharge port 29 as viewed from the front surface. Therefore, the transparent wall is strongly subjected to the cooling function. In consequence, humidity of the outside air is condensed to dew and coagulates.

On the other hand, when the fan 21 for the condenser is operated, the outside air is sucked into the mechanical chamber 2 from the outside air suction port 22, and passes through the condenser 19 to air-cool the condenser. Subsequently, the air is blown against the compressor 18 disposed behind the fan 21 for the condenser to air-cool the compressor. When this sucked outside air cools the condenser 19 and the compressor 18, the air is warmed to form dry air having a high temperature. When the outside air is sucked in this manner, a pneumatic pressure of the mechanical chamber 2 rises. Therefore, the air of the mechanical chamber 2 is blown along the bottom surface of the insulating wall 6, and divided to peripheries. The air directed from the mechanical chamber 2 to the left and the right as viewed from the front surface is blown from the blow-off ports 33, 33 formed at the upper left and right edges of the bottom frame 7. The upper end openings of the blow-off ports 33, 33 are obliquely directed upwards to the outer surfaces of the transparent walls 4, and the air is blown out toward the outer surfaces of the transparent walls 4. In consequence, the outer surfaces of the transparent walls 4 where the dew condensation easily occurs owing to the cooling function from the showroom 3 are warmed and dried. Therefore, the dew condensation on the outer surfaces of the left and right transparent walls 4, 4 is eliminated or suppressed.

Especially, the opening area of the blow-off port 33 disposed outside the lower portion of the transparent wall 4 on the side of the cold air discharge port 29 is set to be larger than that of the blow-off port 33 disposed outside the lower portion of the transparent wall 4 on the side of the cold air suction port 28. As described above, the bottom surface of the insulating wall 6 on the side of the cold air discharge port 29 is formed to be high, so that the air is easily directed toward the blow-off port 33 disposed outside the lower portion of the transparent wall 4 on the side of the cold air discharge port 29. Therefore, a larger amount of the air of the mechanical chamber 2 is blown from the blow-off port 33 to the transparent wall 4 which is more strongly subjected to the cooling function with the cold air from the cold air discharge port 29 and on which the dew condensation easily occurs (a large amount of the air to be blown), and the dew condensation on the transparent wall 4 can effectively be eliminated or suppressed.

Moreover, the air directed front and rear in the mechanical chamber 2 is blown from the lower blow-off ports 37, 37 formed at the front and rear upper edges of the bottom frame 7. When the front and rear doors 13, 13 are closed (FIG. 6), the air blown from the lower blow-off port 37 flows into the blow-off ports 39 formed at the lower sides of the sashes 14 of the doors 13, respectively. The upper end openings of the blow-off ports 39 of the doors 13 are obliquely directed upward to the outer surfaces of the transparent walls 4 of the doors 13, and the air is blown toward the outer surfaces of the transparent walls 4. In consequence, the outer surfaces of the transparent walls 4 of the front and rear doors 13 on which the dew condensation easily occurs owing to the cooling function of the showroom 3 are warmed and dried. Therefore, the dew condensation on the outer surfaces of the transparent walls 4, 4 of the doors 13, 13 can effectively be eliminated or suppressed.

Figure 7:
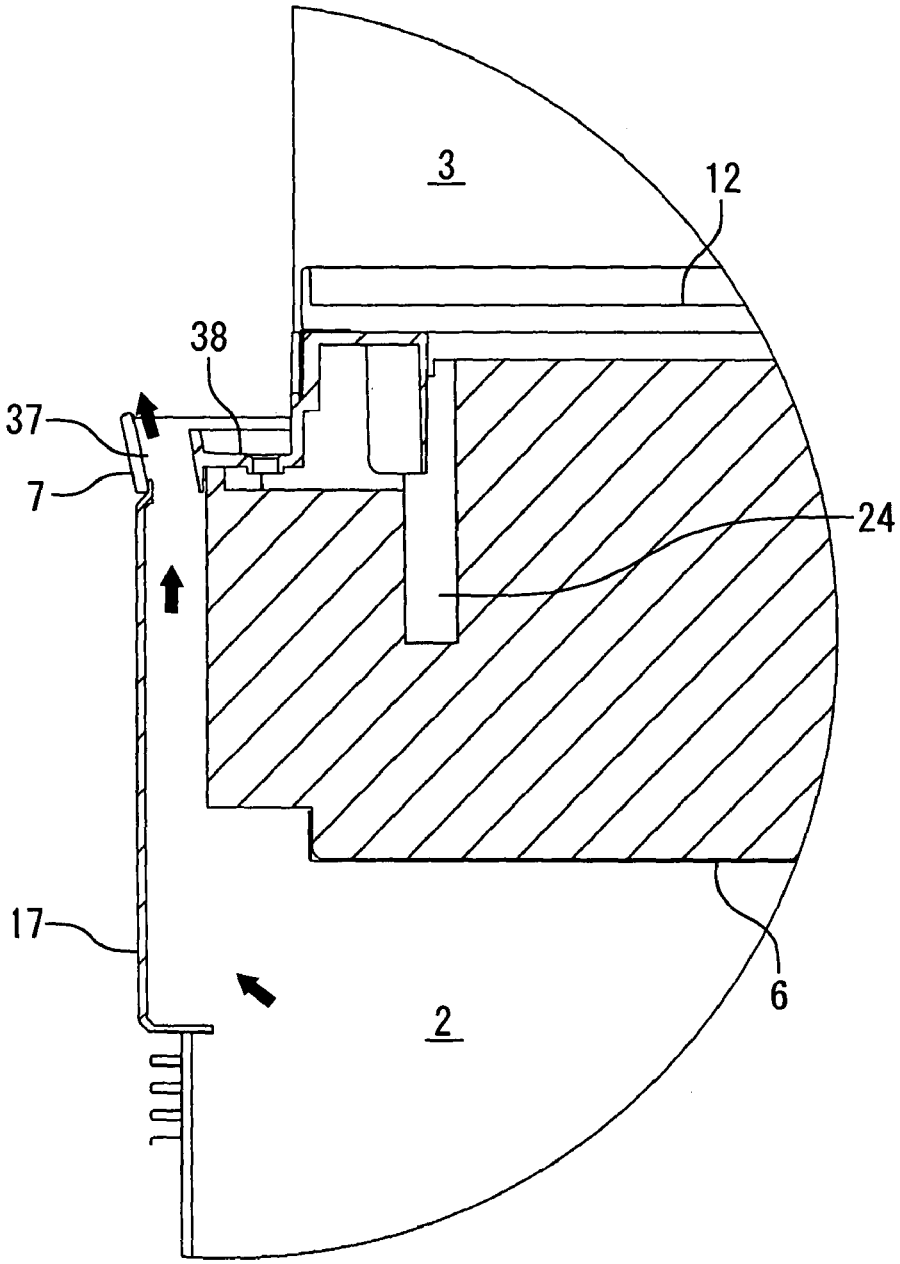
FIG. 7 is an enlarged vertical side view of the bottom frame part of the low-temperature showcase of FIG. 1 in a state in which the rear-surface door is opened.

In this case, when the door 13 is opened, as shown in FIG. 7, the lower blow-off port 37 opens under the opening of the showroom 3. The warm air is blown from the mechanical chamber 2 via this lower blow-off port 37. However, at this time, the upper end opening of the lower blow-off port 37 opens away from the door 13, that is, obliquely opens externally away from the opening of the showroom 3. Therefore, the air is blown toward the outside. When the door 13 is opened, the air blown from the lower blow-off port 37 does not easily flow into the showroom 3, and the cooling function in the showroom 3 is not adversely affected, or the adverse influence can be minimized.

It is to be noted that, in a case where the outside air has a very humid state, the dew condensation unavoidably occurs on the outer surfaces of the transparent walls 4 . . . . This dew condensation water flows down along the outer surfaces of the transparent walls 4, and flows into the water receiving portions 34, 41 as it is. Moreover, the dew condensation water which has flowed into the water receiving portions 34, 34 disposed at the upper left and right edges of the bottom frame 7 passes through the water receiving portions, flows into the cooling chamber 24, and is discharged to the evaporation pan 23 together with defrosting water of the evaporator 26. The dew condensation water which has flowed into the water receiving portions 41 disposed at the lower sides of the sashes 14 of the front and rear doors 13, 13 passes through the water receiving portions, drips down, and is received by the dew receiving portions 38 disposed at the upper front and rear edges of the bottom frame 7 disposed under the water receiving portions. The dew condensation water received in the dew receiving portions 38 flows into the cooling chamber 24, and is similarly discharged to the evaporation pan 23.

In this case, the partition walls 36, 42 are disposed between the blow-off ports 33, 33, 39 and 39 and the water receiving portions 34, 34, 41 and 41, respectively. Therefore, the dew condensation water which flows down along the outer surfaces of the transparent walls 4 turns toward the blow-off ports 33, 39 to wet a surrounding area, and the ports are sealed with the water. This disadvantage can securely or effectively be prevented. In consequence, it is possible to constantly satisfactorily maintain the function of blowing the air to the outer surfaces of the transparent walls 4 which surround the four surrounding surfaces of the showroom 3.

It is to be noted that, in the embodiment, the present invention is applied to the low-temperature showcase in which the four surrounding surfaces of the showroom 3 are surrounded with the transparent walls 4. The present invention other than claim 2 is not limited to this embodiment. The present invention is effective even in a case where the only left and right transparent walls 4 are disposed without disposing any door 13 or a case where the only doors 13 have the transparent walls 4.

What is claimed is:

1. A low-temperature showcase including a showroom having transparent walls, a mechanical chamber constituted under the showroom, and a cooling unit constituted of a compressor, a condenser, and a fan for the condenser arranged in the mechanical chamber, the low-temperature showcase further comprising:

blow-off portions which are formed at lower portions of the transparent walls and which are configured to blow air discharged from the fan for the condenser in the mechanical chamber toward outer surfaces of the transparent walls;

an evaporation pan provided in the mechanical chamber;

a cooling chamber provided under the showroom and above the mechanical chamber with an insulating wall provided between the cooling chamber and the mechanical chamber, said cooling chamber communicating with the evaporation pan; and dew condensation water inflow portions which are defined between the blow-off portions and the outer surfaces of the transparent walls and which allow inflow of dew condensation water flowing down along the outer surfaces of the transparent walls into the cooling chamber comprising an evaporator and a fan, the dew condensation water being discharged to the evaporation pan from the cooling chamber.

2. The low-temperature showcase according to claim 1, wherein the showroom has four surrounding surfaces which are surrounded with the plurality of transparent walls, and the blow-off portions and the dew condensation water inflow portions are formed at the lower portions of the transparent walls of all the surfaces.

3. The low-temperature showcase according to claim 1, further comprising:

a cold air discharge port and a cold air suction port which are formed inwardly from the lower portions of the transparent walls and via which cold air is circulated through the showroom, wherein an amount of the air to be blown from the blow-off portion formed at the lower portion of the transparent wall on the side of the cold air discharge port is set to be larger than an amount of the air to be blown from the blow-off portion formed at the lower portion of the transparent wall on the side of the cold air suction port.

4. The low-temperature showcase according to claim 1, further comprising:

a door which openably closes an opening of the showroom and which includes at least one of the transparent walls and a sash to hold the at least one transparent wall; and a lower blow-off port which is formed under the sash and which blows the air discharged from the fan for the condenser away from the door, wherein the blow-off portion is formed at a lower side of the sash, and the air blown from the lower blow-off port flows into the blow-off portion in a state in which the door is closed.

5. The low-temperature showcase according to claim 2, further comprising:

a cold air discharge port and a cold air suction port which are formed inwardly from the lower portions of the transparent walls and via which cold air is circulated through the showroom, wherein an amount of the air to be blown from the blow-off portion formed at the lower portion of the transparent wall on the side of the cold air discharge port is set to be larger than an amount of the air to be blown from the blow-off portion formed at the lower portion of the transparent wall on the side of the cold air suction port.

6. The low-temperature showcase according to claim 2, further comprising:

a door which openably closes an opening of the showroom and which includes at least one of the transparent walls and a sash to hold the at least one transparent wall; and a lower blow-off port which is formed under the sash and which blows the air discharged from the fan for the condenser away from the door, wherein the blow-off portion is formed at a lower side of the sash, and the air blown from the lower blow-off port flows into the blow-off portion in a state in which the door is closed.

7. The low-temperature showcase according to claim 3, further comprising:

a door which openably closes an opening of the showroom and which includes at least one of the transparent walls and a sash to hold the at least one transparent wall; and a lower blow-off port which is formed under the sash and which blows the air discharged from the fan for the condenser away from the door, wherein the blow-off portion is formed at a lower side of the sash, and the air blown from the lower blow-off port flows into the blow-off portion in a state in which the door is closed.

8. The low-temperature showcase according to claim 5, further comprising:

a door which openably closes an opening of the showroom and which includes at least one of the transparent walls and sash to hold the at least one transparent wall; and a lower blow-off port which is formed under the sash and which blows the air discharged from the fan for the condenser away from the door, wherein the blow-off portion is formed at a lower side of the sash, and the air blown from the lower blow-off port flows into the blow-off portion in a state in which the door is closed.

9. The low-temperature showcase according to claim 1, wherein the dew condensation water that flows into the cooling chamber is discharged to the evaporation pan together with defrosting water from the evaporator provided in the cooling chamber.

* * * * *